US007523831B2

(12) United States Patent
Ottow et al.

(10) Patent No.: US 7,523,831 B2
(45) Date of Patent: Apr. 28, 2009

(54) CLASSIFICATION OF SPLINTERS AND WOOD CHIPS

(76) Inventors: Manfred Ottow, Walporzheimer Strasse 24, D-13465 Berlin (DE); Robin Ottow, Sperrstrasse 84, CH-4057 Basel (CH)

( * ) Notice: Subject to any disclaimer, the term of this patent is extended or adjusted under 35 U.S.C. 154(b) by 45 days.

(21) Appl. No.: 11/591,935

(22) Filed: Nov. 2, 2006

(65) Prior Publication Data

US 2007/0095728 A1 May 3, 2007

(30) Foreign Application Priority Data

Nov. 2, 2005 (DE) ..... 10 2005 052 620

(51) Int. Cl.
*B03B 5/28* (2006.01)
*B04B 5/10* (2006.01)

(52) U.S. Cl. ..... 209/723; 209/710; 209/711; 209/720; 209/721; 209/722

(58) Field of Classification Search ..... 209/710–716, 209/720, 721, 723, 148, 154
See application file for complete search history.

(56) References Cited

U.S. PATENT DOCUMENTS

| | | | | |
|---|---|---|---|---|
| 1,950,069 | A * | 3/1934 | Stein | 209/139.2 |
| 3,643,800 | A * | 2/1972 | Mansson | 209/722 |
| 3,667,600 | A * | 6/1972 | Oi et al. | 209/139.2 |
| 4,166,027 | A * | 8/1979 | Smith | 209/139.1 |
| 4,211,641 | A * | 7/1980 | Jager | 209/710 |
| 4,470,902 | A * | 9/1984 | Yoshimori | 209/139.2 |
| 4,742,919 | A * | 5/1988 | Eriksson | 209/44.1 |
| 6,193,075 | B1 * | 2/2001 | Plas | 209/715 |
| 7,108,138 | B2 * | 9/2006 | Simpson | 209/720 |

FOREIGN PATENT DOCUMENTS

| | | |
|---|---|---|
| DE | 26 36 989 | 2/1978 |
| DE | 34 46 701 C2 | 7/1986 |
| DE | 35 01 960 C2 | 8/1986 |

* cited by examiner

*Primary Examiner*—Patrick H Mackey
*Assistant Examiner*—Terrell H Matthews
(74) *Attorney, Agent, or Firm*—Collard & Roe, P.C.

(57) ABSTRACT

A method and a device classifies splinters and wood chips. The device includes a centrifugal classifying unit, a countercurrent classifying unit, a separating funnel for the coarse fraction and a separating cyclone for the fine fraction. A gas or a gas mixture is circulated in the system via a blower. It is tangentially introduced into the lower classifying chamber, initially flows through the countercurrent classifier, through the gaps between the blades of the centrifugal classifier and then into the separating cyclone before being returned to the blower.

13 Claims, 2 Drawing Sheets

CLASSIFICATION OF SPLINTERS AND WOOD CHIPS

CROSS REFERENCE TO RELATED APPLICATIONS

Figure 1:
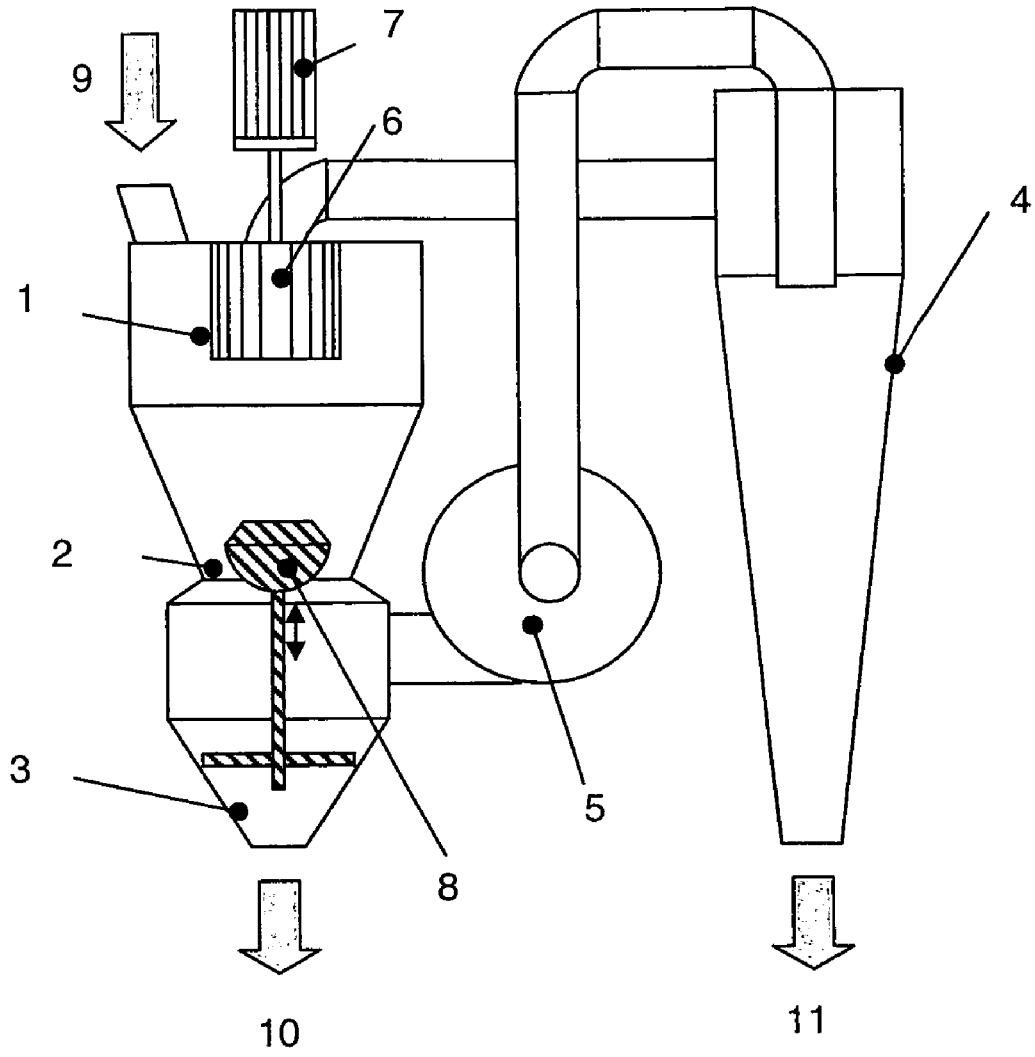

Applicants claim priority under 35 U.S.C. §119 of German Application No. 10 2005 052 620.9 filed Nov. 2, 2005.

The invention pertains to a method and a device for classifying splinters and wood chips.

Splinters and wood chips accumulating in a saw mill are usually subjected to a classification process, i.e., the initial mixture of splinters and wood chips of different sizes is separated in accordance with particle size or settling velocity in a large-scale separation process. The classification is carried out, e.g., in order to separate undesirable fine fractions from wood chips or to separate wood chips from sawdust. The manufacturing industry, e.g., facilities for the production of particle boards or cellulose, typically subject sawdust and wood chips to further classification steps in order to obtain the most suitable fraction for the respective application.

In screening plants according to the state of the art, splinters and wood chips are screened and packaged for distribution. Various grain sizes can be obtained by utilizing screen plates with different mesh widths.

For example, DE 35 01 960 C2 discloses a wood chip separator that consists of a box-like main screen with screen planes that carry out circular screening movements and a downstream heavy material enrichment device.

DE 34 46 701 C2 discloses a device for classifying wood chips into two fractions of different sizes that consists of a shaking conveyor with successively arranged intermediate decks. The intermediate decks are covered with screens, wherein the oversize is conveyed into a ring knife cutting device while the bottom of the shaking conveyor feeds into a rigid-hammer crusher mill.

However, these devices for classifying splinters and wood chips by means of screening systems have the following disadvantages:

- rigid screen plates only make it possible to vary the particle size to be separated by exchanging the screens. The operation of the classifying system needs to be interrupted for this exchange. Infinitely variable adjustments of the particle size to be separated are not possible, particularly during the operation of the system.
- the screening systems frequently become obstructed by splinters and wood chips that get stuck in the screen openings such that the respective system needs to be shut down and cleaned.
- long, thin chips convolute on the screens and are incorrectly added to the coarse fraction or obstruct the screen surfaces.

DE 26 36 989 discloses a fragmentizing machine for light materials, particularly wood chips, in which the wood chips drop from a dispensing device and are acted upon by a cross-flow that extends perpendicular to the dropping direction. This makes it possible to remove undesirable coarse and, in particular, heavier foreign matter particles such as metallic particles or rocks from the material being dispensed. The cross-flow acting upon the unclassified material dropping from the dispensing device subjects this material to a turbulent motion and only entrains the specifically lighter material particles to be fragmentized. Due to their higher specific weight, the foreign matter particles have a much higher drop energy than the material particles to be fragmentized such that they are barely deflected and continue to drop in order to be separated from the remaining material particles.

However, this fragmentizing machine only makes it possible to separate particles, the specific weight of which differs significantly, e.g., wood chips and rocks. An adequate separation of wood chips or sawdust in accordance with their different sizes cannot be realized because their specific weights do not differ by the required amount.

Consequently, the invention is based on the objective of making available a method and a device that ensure the classification of splinters and wood chips while simultaneously eliminating the disadvantages of the state of the art.

With respect to the method, this objective is attained, according to the invention, by dispensing a mixture of splinters and wood chips containing coarser and finer particles with different masses at a centrifugal classifying unit and dropping the mixture into a classifying chamber, in which the majority of the mixture is transported into a rotor of the centrifugal classifying unit by means of a countercurrent of gas or a gas mixture circulated with the aid of a blower, throwing back coarser particles into the upper classifying chamber against the gas flow by the rotor, entraining finer particles by the gas flow against the centrifugal effect of the rotor, transported to a separating cyclone and separated, delivering the particles that were either elected by the rotor or dropped past the rotor to a countercurrent classifier and returning the content of fine particles that has passed by the centrifugal classifying unit to the centrifugal classifying unit with the corresponding gas flow, and separating the coarse fraction in a separating funnel at the end of the countercurrent classifier. The objective with respect to the device is attained, according to the invention, by an arrangement containing a centrifugal classifying unit, a countercurrent classifying unit, a separating funnel for the coarse fraction of the mixture of splinters and wood chips, a separating cyclone for the fine fraction of the mixture, at least one blower generating at least one gas flow between the countercurrent classifier, the centrifugal classifying unit and the separating cyclone, the gas flow transporting the majority of the mixture supplied through an inlet opening in the device into a rotor of the centrifugal classifying unit, a suction channel on the axis of the rotor transporting finer particles to a separating cyclone, from which the finer particles emerge at a lower opening in order to be additionally processed, and a tube transporting the circulating gas flow to the blower, a countercurrent classifier arranged underneath the centrifugal classifying unit, wherein the blower transports a gas flow from the countercurrent classifier in the direction of the centrifugal classifying unit and the gas flow returns the content of finer particles that has passed by the centrifugal classifying unit to the centrifugal classifying unit, and a separating funnel transporting coarser particles from the countercurrent classifier to an outlet opening and subsequent additional processing.

Advantageous embodiments of the inventive method and device are discussed below.

The inventive device consists of a centrifugal classifying unit, a countercurrent classifying unit, a separating funnel for the coarse fraction and a separating cyclone for the fine fraction.

A gas or a gas mixture is circulated in the system with the aid of a blower. It is tangentially introduced into the lower classifying chamber, initially flows through the countercurrent classifier, through the gaps between the blades of the centrifugal classifier and then into the separating cyclone before being returned to the blower.

The product is supplied to the top of the centrifugal classifying unit and drops into the upper classifying chamber, wherein the countercurrent of gas transports a majority of the product into the rotor. Coarser particles are thrown back into the upper classifying chamber against the gas flow by the rotor while finer particles are entrained by the gas flow against the centrifugal effect of the rotor. The fine fraction is then separated in the separating cyclone.

The particles that are either ejected by the rotor or drop past the rotor then reach the countercurrent classifier. In this classifier, coarser particles drop through the annular surface surrounding the flow member due to the gravitational force. Lighter particles are entrained upward by the gas flow and once again returned to the rotor. The coarse fraction is then discharged in the separating funnel.

The utilization of aerodynamic classification provides the following advantages:

- particle sizes can be adjusted in an infinitely variable fashion during the operation such that different customer requirements can be taken into account,
- the system is controllable such that an optimal product quality can be ensured under changing loads and material properties (moisture, resin content, winter wood, etc.); screening systems according to the state of the art, in contrast, are not controllable,
- the system cannot be obstructed such that the availability is increased,
- long, thin chips cannot convolute into so-called wool.

The particle size to be separated by the centrifugal classifier is dependent on the rotor speed or its circumferential speed, respectively, and the blower power or gas speed during the passage between the rotor blades. A higher rotor speed or a lower blower power result in the separation of finer particle sizes.

The particle size to be separated by the countercurrent classifier is dependent on the gas speed in the narrowest cross section and therefore the blower power as well as the free cross-sectional surface. In this case, a higher blower power or a smaller cross section results in the separation of coarser particle sizes.

In addition, the blower power significantly influences the discharge of fine material. A higher blower power results in the discharge of larger quantities of material.

The supplied material flow also influences the discharge of fine material. An increased material flow results in the discharge of smaller quantities in this case.

Since it is desirable to discharge the largest quantity of fine material possible and to realize the highest material throughput possible, the blower power is maintained constant at the highest value possible. In order to still make it possible to vary the particle size to be separated in the countercurrent classifier, the free cross section can be adjusted in this classifier. For this purpose, the flow member is arranged in an adjustable fashion. The free cross section is increased by raising the flow member and decreased by lowering the flow member.

This adjusting option is important for adapting the two separation processes. If a finer fraction is separated in the centrifugal classifier than in the countercurrent classifier, a mean fraction is created that can no longer be discharged from the system. This mean fraction consequently is excessively coarse for passing through the centrifugal classifier and excessively fine for passing through the countercurrent classifier. In other words, the parameters need to be adjusted such that the particle size separated by the countercurrent classifier is slightly finer than that separated by the centrifugal classifier. If the particle sizes to be separated differ excessively, the discharge of fine material decreases, i.e., the coarse fraction contains an excessive amount of the fine fraction.

Air is advantageously utilized as the gas mixture. When classifying substances that represent a fire or explosion hazard, the gas used advantageously consists of nitrogen because this gas reduces the risk of fires or explosions.

The invention is described in greater detail below with reference to an embodiment that is illustrated in the two figures. In these figures, FIG. 1 schematically shows an inventive system consisting of a centrifugal classifying unit, a countercurrent classifying unit, a separating funnel for the coarse fraction and a separating cyclone for the fine fraction, and FIG. 2 schematically shows the gas flow as well as the path of particles with different masses through the inventive system.

According to FIG. 1, an inventive system consists of a centrifugal classifying unit 1, a countercurrent classifying unit 2, a separating funnel for the coarse fraction 3 and a separating cyclone for the fine fraction 4.

Figure 2:
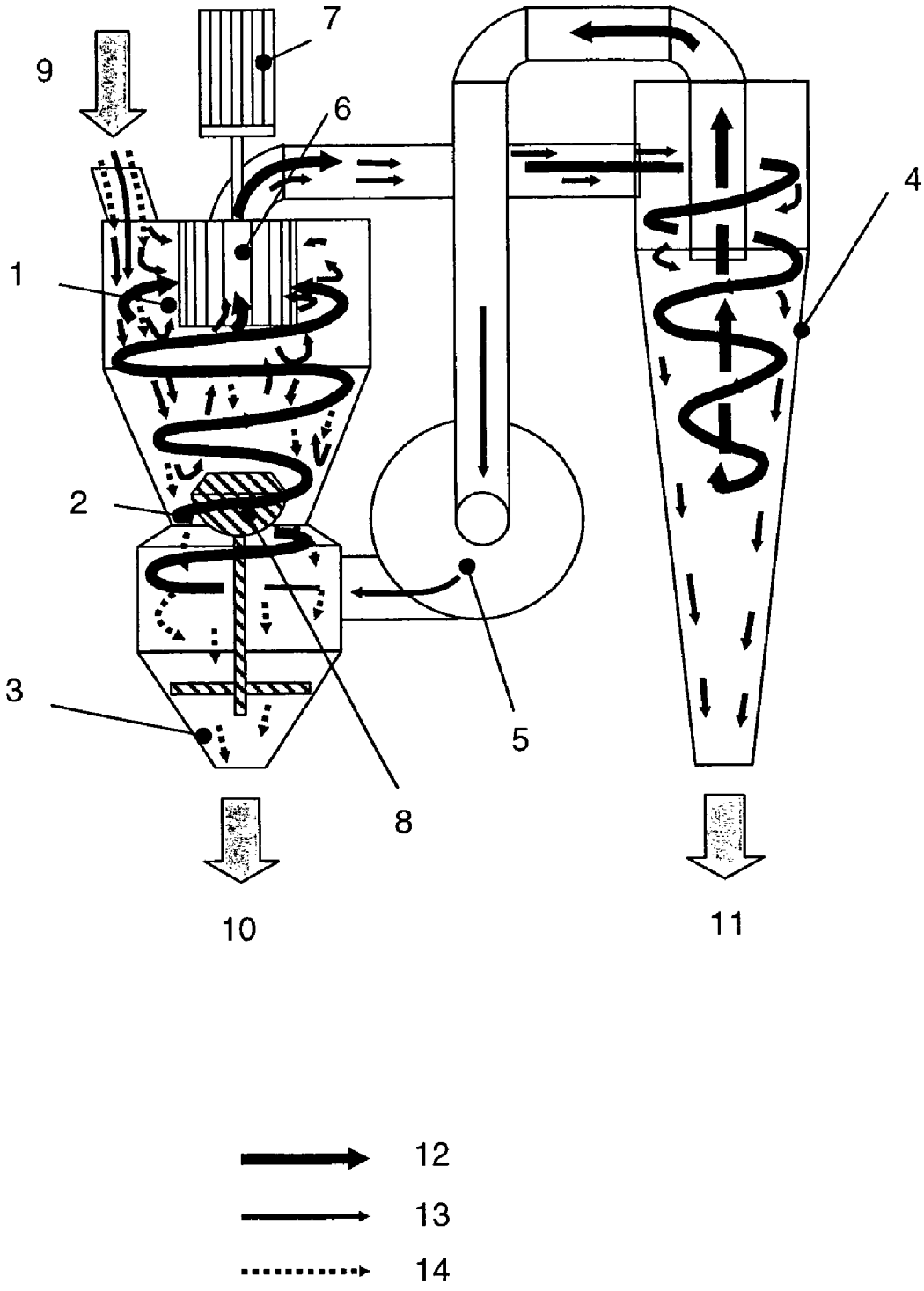

A gas mixture 12, particularly air, is circulated in the system by means of the blower 5 as shown in FIG. 2. The gas mixture is tangentially introduced into the lower classifying chamber and then flows upward in the direction of the separating cyclone 4 in the form of a helical motion through the blades of the circulating rotor 6. At this location, the gas mixture flows downward along a helically narrowing path, then turns around before it reaches the outlet opening 11, flows upward in the center of the separating cyclone 4 and follows the pipeline to the suction side of the blower 5.

A mixture of splinters and wood chips consisting of coarser particles 14 and finer particles 15 with different masses is dispensed on top of the centrifugal classifying unit 1 and drops into the upper classifying chamber, wherein the countercurrent of gas 1 transports the majority of the product into the rotor 6. Coarser particles 14 are thrown back into the upper classifying chamber against the gas flow by the rotor 6 and finer particles 13 are entrained by the gas flow against the centrifugal effect of the rotor 5. The fine fraction is then separated in the separating cyclone 4.

The particles that are either ejected by the rotor or drop past the rotor then reach the countercurrent classifier 2. In this classifier, coarser particles 14 drop through a through-opening against the gas flow due to the gravitational force while lighter particles 13 are entrained upward by the gas flow and once again returned to the rotor 6. The coarse fraction 14 is then discharged from the separating funnel 3.

The inventive separation principle is particularly suitable for the following separation tasks:

- separation of wood chips from sawdust with a low wood chip content (approximately 1 to 10 wt. %),
- separation of fine fractions from wood chips with a low content of fine particles (approximately 1 to 10 wt. %),
- fractionating sawdust with arbitrary particle sizes.

The adjustable flow member 8, the adaptation of the number of rotor blades and the adjustment of the optimal rotor and blower speeds make it possible to carry out all these separations with the same system.

Analytical comparison screen technique⇆ aerodynamic classification

Separation task: removing the fine fraction from wood chips

| Test screen | Fraction | Content [%] Screen technique (typical values) | Aero-dynamic classification (at full load) |
|---|---|---|---|
| 45 mm round hole | F1 coarse fraction | 0.63 | 0 |
| 8 mm rod | F2 thick fraction | 10.49 | 15.63 |
| 13 mm round hole | F3-1 normal fraction | 56.36 | 74.22 |
| 7 mm round hole | F3-2 normal fraction | 22.63 | 8.6 |
| 3 mm round hole | F4 fine fraction | 7.97 | 1.56 |
| Bottom trough | F5 screening dust | 1.92 | 0 |

The screen analysis values indicate that, in comparison with the screen technique, aerodynamic classification makes it possible to reduce the fine fraction (F4 fraction) from just under 8% to 1.56% —less than one-fifth—namely also under most unfavorable conditions (operation at full load). The residual quantities of screening dust that amount to approximately 2% in the screen technique are reduced below the measurability threshold. In aerodynamic classification, it is also particularly advantageous that the percentage of the F4/F5 fraction can be adjusted in an infinitely variable fashion. This makes it possible to fully utilize the tolerance ranges of the customers and to thusly maximize the salable product quantity.

| List of reference symbols | |
|---|---|
| 1 | centrifugal classifying unit |
| 2 | Countercurrent classifying unit |
| 3 | Separating funnel for coarse fraction |
| 4 | Separating cyclone for fine fraction |
| 5 | Blower |
| 6 | Rotor |
| 7 | Rotor drive |
| 8 | Flow member |
| 9 | Product inlet |
| 10 | Product outlet for coarse fraction |
| 11 | Product outlet for fine fraction |
| 12 | Gas mixture |
| 13 | Fine fraction |
| 14 | Coarse fraction |

The invention claimed is:

1. A method for classifying a mixture of splinters and wood chips comprising coarser and finer particles with different masses, wherein the mixture is dispensed at a centrifugal classifying unit and drops into a classifying chamber, in which the majority of the mixture is transported into a rotor of the centrifugal classifying unit by means of a countercurrent of gas or a gas mixture circulated with the aid of a blower, coarser particles are thrown back into the upper classifying chamber against the gas flow by the rotor and finer particles are entrained by the gas flow against the centrifugal effect of the rotor, transported to a separating cyclone and separated, the particles that were either ejected by the rotor or dropped past the rotor are delivered to a countercurrent classifier comprising a through-opening around a flow member arranged in an adjustable fashion, the through-opening having a free cross section increased by raising the flow member and decreased by lowering the flow member, and the content of fine particles that has passed by the centrifugal classifying unit is returned to the centrifugal classifying unit with the corresponding gas flow, and the coarse fraction is separated in a separating funnel at the end of the countercurrent classifier.

2. The method for classifying a mixture of splinters and wood chips according to claim 1, wherein the blower generates at least one circulating gas flow between the countercurrent classifier, the centrifugal classifying unit and the separating cyclone.

3. The method for classifying a mixture of splinters and wood chips according to claim 1, wherein gas is also. introduced into the gas flow from outside and/or discharged outward.

4. The method for classifying a mixture of splinters and wood chips according to claim 1, wherein a finer particle size to be separated is adjusted in the centrifugal classifier by increasing the rotational speed of the rotor or reducing the power of the blower and vice versa.

5. The method for classifying a mixture of splinters and wood chips according to claim 1, wherein a coarser particle size to be separated is adjusted in the countercurrent classifier by increasing the power of the blower or reducing the cross section of the countercurrent and vice versa.

6. The method for classifying a mixture of splinters and wood chips according to claim 1,wherein the discharge of the fine fraction is increased by increasing the power of the blower and vice versa.

7. The method for classifying a mixture of splinters and wood chips according to claim 1, wherein the discharge of the fine fraction is increased by reducing the supplied quantity of the mixture of splinters and wood chips and vice versa.

8. A device for classifying a mixture of splinters and wood chips comprising coarser and finer particles with different masses, said device comprising a centrifugal classifying unit, a countercurrent classifying unit comprising a through-opening around a flow member arranged in an adjustable fashion, a separating funnel for the coarse fraction and a separating cyclone for the fine fraction wherein at least one blower generates at least one gas flow between the countercurrent classifier, the centrifugal classifying unit and the separating cyclone, the gas flow transports the majority of the mixture supplied through an inlet opening in the device into a rotor of the centrifugal classifying unit, a suction channel on the axis of the rotor transports finer particles to the separating cyclone, from which the finer particles emerge at a lower opening in order to be additionally processed, and a tube transports the circulating gas flow to the blower, the countercurrent classifier is arranged underneath the centrifugal classifying unit, wherein the through-opening has a free cross section increased by raising the flow member and decreased by lowering the flow member, wherein the blower transports a gas flow from the countercurrent classifier in the direction of the centrifugal classifying unit and the gas flow returns the content of finer particles that has passed by the centrifugal classifying unit to the centrifugal classifying unit, and the separating funnel transports coarser particles from the countercurrent classifier to an outlet opening and subsequent additional processing.

9. The device for classifying a mixture of splinters and wood chips according to claim 8, wherein the gas flow circulates between the countercurrent classifier, the centrifugal classifying unit and the separating cyclone.

10. The device for classifying a mixture of splinters and wood chips according to claim 8, wherein gas is also introduced into the gas flow from outside and/or discharged outward.

11. The device for classifying a mixture of splinters and wood chips according to claim 8, wherein the particle size to be separated by the countercurrent classifier is finer than that to be separated by the centrifugal classifier.

12. The device for classifying a mixture of splinters and wood chips according to claim 8, wherein the gas comprises nitrogen.

13. The device for classifying a mixture of splinters and wood chips according to claim 8, wherein the gas mixture comprises air.

* * * * *